United States Patent [19]

Marontate et al.

[11] Patent Number: 4,922,987

[45] Date of Patent: May 8, 1990

[54] SECURE TYPE FOLDING DOOR

[75] Inventors: John D. Marontate, Forest Grove; Ralph D. Jones, Cornelius; Mark F. Lewis, Portland, all of Oreg.

[73] Assignee: Woodfold-Marco Mfg., Inc., Forest Grove, Oreg.

[21] Appl. No.: 294,681

[22] Filed: Jan. 9, 1989

[51] Int. Cl.[5] ..... E05D 15/26

[52] U.S. Cl. ..... 160/183; 160/199

[58] Field of Search ..... 160/199, 206, 196.1, 160/236, 229.1, 213, 233, 113, 114, 118, 119, 135, 183; 16/376, 387, 356

[56] References Cited

U.S. PATENT DOCUMENTS

| | | | |
|---|---|---|---|
| 2,689,003 | 9/1954 | Helbert et al. | 160/196.1 X |
| 3,033,283 | 5/1962 | Jorgensen | 160/199 X |
| 3,168,135 | 2/1965 | Beifuss | 160/183 X |
| 3,359,594 | 12/1967 | Pastoor | 16/356 |
| 3,405,756 | 10/1968 | Harris | 160/183 X |
| 3,529,651 | 9/1970 | Bender | 160/183 |
| 3,640,333 | 2/1972 | Leclerc | 160/199 X |
| 3,901,302 | 8/1975 | Dagenais | 160/183 |
| 4,276,919 | 7/1981 | Walters | 160/199 X |
| 4,380,260 | 4/1983 | Labelle | 160/199 X |
| 4,386,645 | 6/1983 | Dever et al. | 160/183 |
| 4,497,357 | 2/1985 | Labelle | 160/199 |
| 4,660,613 | 4/1987 | Dagenais | 160/199 |
| 4,736,785 | 4/1988 | Sevster | 160/229.1 X |

FOREIGN PATENT DOCUMENTS

| | | | |
|---|---|---|---|
| 699309 | 12/1964 | Canada | 160/199 |

*Primary Examiner*—David M. Purol

*Attorney, Agent, or Firm*—Eugene D. Farley

[57] ABSTRACT

An accordion type folding door assembly designed for mounting across the entrance to a space to be secured. The panels of the assembly are interconnected by supplemental hinges completely shielding the spaces from vandalism and forcible entry, while simultaneously rigidifying and stiffening the door structure.

5 Claims, 2 Drawing Sheets

SECURE TYPE FOLDING DOOR

BACKGROUND AND GENERAL STATEMENT OF THE INVENTION

This invention pertains to accordion type folding doors secured against vandalism and forcible entry.

A widely used and popular accordion type folding door comprises an assembly of vertically arranged panels placed side-by-side and suspended from a suitable track. The adjacent side edges of the panels are interconnected by sheet vinyl plastic hinges, the use of which is attended by two serious disadvantages:

In the first place, the vinyl hinges are easily cut by means of a knife or other sharp instrument, thereby vandalizing the door and providing openings into which crowbars or other tools may be inserted for the purpose of gaining entry.

Second, since the vinyl hinges are flexible and extend the entire length of the door, they impart a degree of flexibility and instability to the door assembly, rendering it unsuited for use in the protection of secure areas.

It is the general purpose of the present invention to provide an accordion type folding door assembly wherein the panel components are hinged to each other by means of strong, rigid, supplemental hinge members which cannot be cut with a knife and which staunchly resist attempts to separate the panels by destroying their hinging connections.

It is another important object of the present invention to provide an accordion type folding door assembly which is strong and rigid and which accordingly affords substantial protection to a space behind the door which is to be secured against entry.

A further object of the present invention is the provision of a secure-type accordion folding door which may be provided by the manufacturer as an alternate style of his product, without requiring the use of radically modified door components.

Still a further object of the present invention is the provision of an accordion type folding door which is of good appearance; easily assembled; easily installed; and, after installation, of long life substantially free from serious maintenance requirements.

Broadly stated, the folding door assembly of our invention, which accomplishes the foregoing and other objects, comprises a plurality of vertically arranged panels adapted to be suspended from a mounting track in vertical side-by-side arrangement.

Upper and lower primary hinges hinge together the upper and lower margins of each pair of panels. Supplemental hinging assemblies made of tough, durable components interconnect the panels in the spaces intermediate the primary hinges.

Each supplemental hinge assembly comprises a plurality of knuckles made of hard durable plastic or metal and tongue and groove or other means for attachment of the knuckles to the side margins of the adjacent panels in alternating arrangement, i.e. with alternate knuckles attached to the same panel.

A hinge pin made of steel or other stout material is received in the knuckles. It extends the entire distance between the pin hinges. In effect, it "floats" in its seated position, being unsecured directly to a structural member, but trapped between the primary hinges so that the hinge assembly cannot be inadvertently disassembled.

The space between the panels thus is armored and rendered invulnerable to attack.

THE DRAWINGS

DETAILED DESCRIPTION OF A PREFERRED EMBODIMENT OF THE INVENTION

Figure 1:
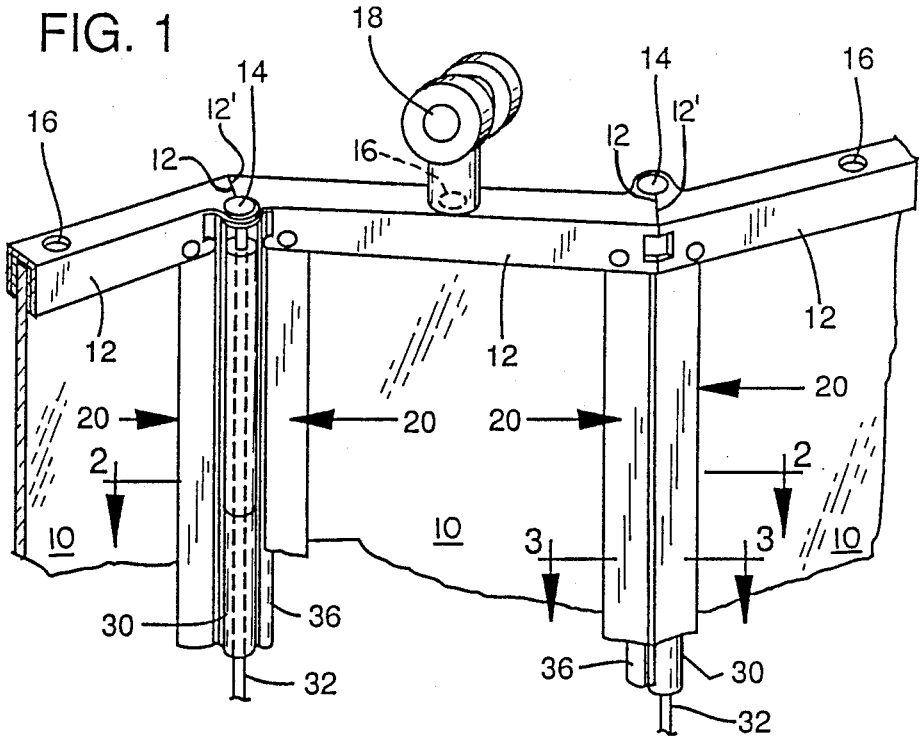
FIG. 1 is a fragmentary view in elevation of the herein described accordion type folding door assembly in its extended, or closed position.
Figure 2:
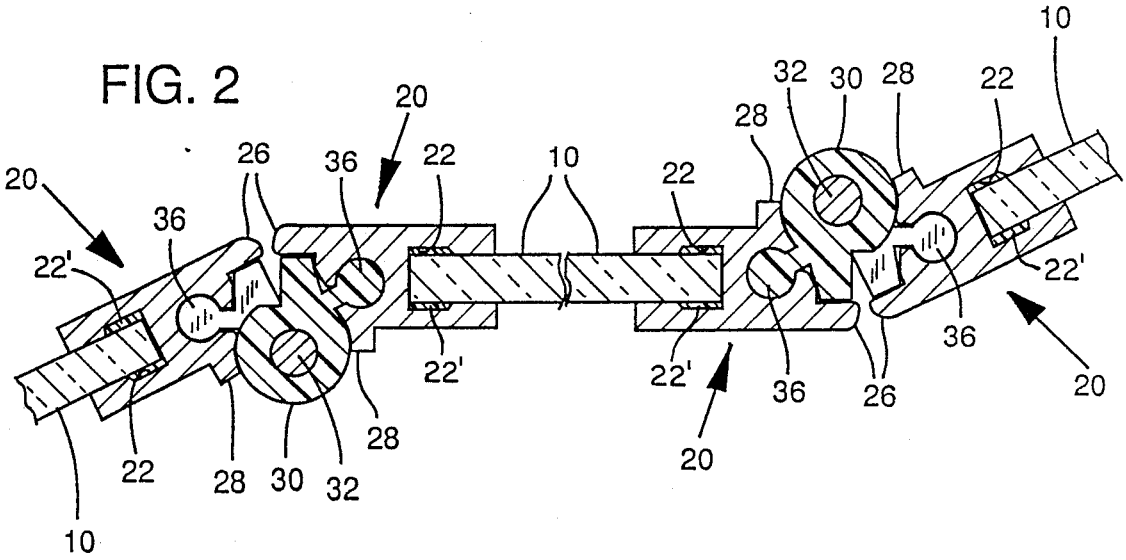
FIG. 2 is a transverse sectional view taken along line 2—2 of FIG. 1.

As illustrated in FIGS. 1 and 2, accordion type folding doors of the class to which the present invention belongs basically comprise a plurality of elongated panels 10 hinged together along their longitudinal side edges into the illustrated pleated or zig zag arrangement. The panels may comprise any suitable structural material, such as wood, particle board, clear or opaque plastic, or metal.

Panels 10 are suitably framed, in part by cap pieces 12 mounted on the top and bottom edges of each panel.

In the illustrated form of the invention, the cap pieces are channel shaped in cross section and receive the top and bottom margins of the panels. They are hinged together on opposite sides by means of primary hinges which serve a structural function. In the illustration, the primary hinges comprise pin hinges 14.

The meeting end edges 12' of the channel shaped cap pieces 12 are configured in such a manner as to provide stop tabs, which limit the relative movement of the panels so that they assume the desired zig zag configuration when the door is extended.

The central segments of cap pieces 12 are provided with openings 16. These provide means for mounting, on selected ones, roller assemblies 18 by means of which the door is suspended on a track, not illustrated but of conventional construction. The track is mounted across the entrance of the space to be closed off by the door.

The juxtaposed longitudinal side edges of the panels mount longitudinal side framing members indicated generally at 20.

Each side frame 20 may comprise a strip of extruded metal having the cross section illustrated in FIG. 2. Each is shaped with an inner side margin provided with a longitudinal recess or groove 22. This is dimensioned to receive the side margin of panel 10, as well as a quantity of adhesive binding 22' by means of which the panel margin is united adherently to the side frame.

Each side frame 20 also is provided along its outer margin with a longitudinally extending groove 24. It also is provided, along its sides, with a pair of longitudinally extending screening flanges 26, 28. These serve to shield the mechanism of the secondary hinge by means of which two adjacent panels are coupled together in hinging relation.

Pin hinges 14 provide the principal support for the door structure, by means of which the panels are hinged to each other in the desired configuration. However, there also is provided between the adjacent margins of panels 10 supplemental hinging means extending the full length of the panels, from top to bottom.

In addition to providing a hinging function, these serve a barrier function, sealing off the space between adjacent panels in such a manner as to prevent access to the area behind the door. They replace the sheet vinyl or other plastic hinges which heretofore have been widely used to hinge the panels together. As noted above, plastic hinges of the latter class are widely subject to vandalism by cutting or mutilating with a sharp instrument.

Figure 3:
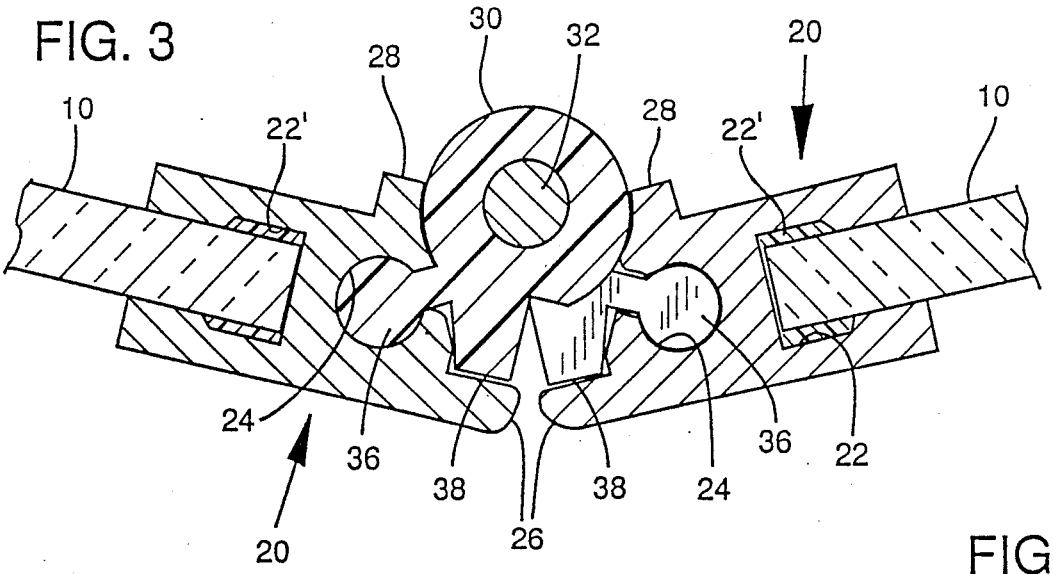
FIG. 3 is a fragmentary, enlarged detail view in section taken along line 3—3 of FIG. 1.
Figure 5:
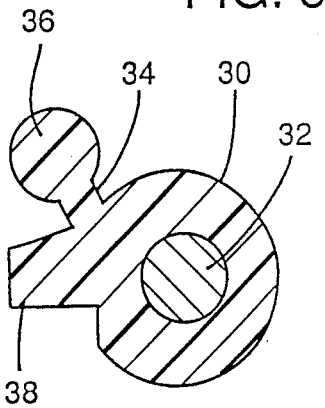
FIG. 5 is a detail sectional view illustrating the supplemental hinging component of the presently described folding door.
Figure 4:
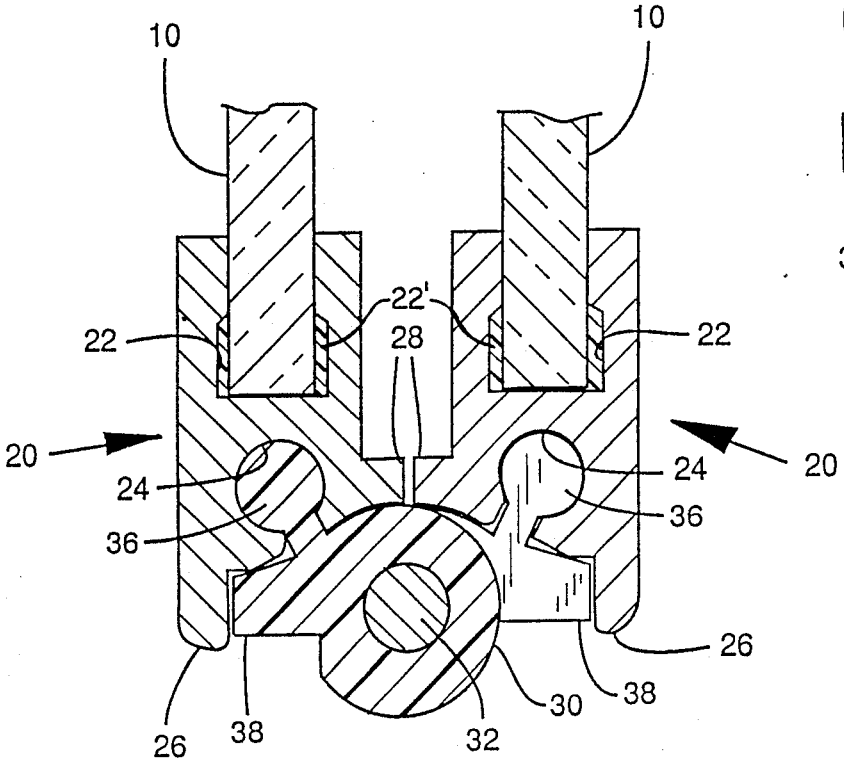
FIG. 4 is a transverse, section view similar to FIG. 3, but with the door in its folded or open position.

As shown particularly in FIGS. 3-5, the supplemental hinge assemblies comprise a plurality of hinge knuckles 30 disposed end to end between each pair of adjacent framing members 20, and a hinge pin 32 received by the knuckles and extending continuously the length of the assembly.

As viewed in cross section, hinge knuckles 30 are provided with longitudinally extending tongues 34 terminating in beads 36. They also are provided with longitudinally extending flanges 38.

Tongues 34 with associated beads 36 cooperate with grooves 24 on framing member 20 to form tongue and groove connections by means of which the knuckles are coupled to framing members 20, in alternating positions. In other words, alternate ones of knuckles 30 are coupled to the same framing member, thus forming the hinge.

Flanges 38 serve a locating and shielding function.

Hinge pin 32 "floats" in its installed relation to the hinge knuckles. It is not secured directly to a structural member. However, it is trapped between top and bottom pin hinges 14 so that it remains at all times in operative position.

Both elements of the supplemental hinge assembly are fabricated from hard, durable, strong material so that they resist forcible entry through the supplemental hinge structure. Thus pin 32 preferably is made of steel. Knuckles 30 preferably are fabricated from a strong, hard, plastic such as rigid vinyl plastic.

Thus, when the door is in its extended position of FIGS. 1 and 2, the joints on one side are protected by means of flanges 26 on panel side frames 20. On the other side of the door, the space between the panels is protected by the continuous barrier presented by knuckles 30 mounted on steel hinge pins 32. The door accordingly is protected against vandalism and entry by the application of force other than a force of door-destructive caliber.

Having thus described in detail a preferred embodiment of the present invention, it will be apparent to those skilled in the art that various physical changes could be made in the device described herein without altering the inventive concepts and principles embodied. The present embodiment is therefore to be considered in all respects as illustrative and not restrictive, the scope of the invention being indicated by the appended claims. All changes which come within the meaning and range of equivalency of the claims are therefore to be embraced therein.

I claim:

1. An accordion type folding door assembly adapted for mounting on a track positioned across a space to be secured, the folding door assembly comprising:

(a) a plurality of adjacent panels each including a top end having an upper margin and a bottom end and being arranged vertically side-by-side, with juxtaposed side edges, (b) mounting means on the upper margins of selected ones of the panels for mounting the assembly on the track, (c) upper and lower primary hinge means mounted at the top and bottom of each panel for hinging said adjacent panels together, (d) stop means on each panel arranged to engage the stop means on the adjacent panel to limit the relative closing movement of the panels so that they assume a zig zag configuration in the extended, closed condition of the door, (e) a framing member on each panel juxtaposed side edge, the framing member having inner and outer side margins, (f) on the inner side margin of each framing member panel fastening means for fastening the framing member to the adjacent panel side edges, (g) a plurality of hinge knuckles disposed end-to-end in alternating arrangement between each pair of adjacent framing members and between each pair of upper and lower primary hinge means, (h) connecting means connecting the knuckles to the outer side margins of the adjacnet framing members in alternating arrangement, (i) floating hinge pin means interconnecting the knuckles, the knuckles and floating hinge pin means forming a supplemental hinge, (j) the connecting means connecting the knuckles to the adjacnet panel framing members comprising tongue and groove connecting means, (k) the tongue and groove connecting means comprising a groove component located in the framing member and a tongue component located on the knuckles, (l) the assembly including an outwardly extending flange on each knuckle radially spaced from the tongue component and positioned for screening the space between adjacent panels during operation of the door.

2. The folding door assembly of claim 1 including cap pieces disposed on the top and bottom of each panel, each cap piece including a pair of meeting end edges, and the stop means comprising the meeting end edges of the cap pieces on adjacent panels configured for limiting the relative angular movement of adjacent panels during closing of the door.

3. The folding door assembly of claim 1 wherein the primary hinge means comprise pin hinges positioned on the top and bottom of each panel.

4. The folding door assembly of claim 1 wherein the panel fastening means on the inner side margins of each panel comprises an adhesive-filled recess.

5. The folding door assembly of claim 1 wherein the outer side margin of each framing member includes a vertical screening flange, positioned to screen the supplemental hinge from the exterior in the closed position of the door.

* * * * *